US012643005B2

(12) United States Patent
Ward et al.

(10) Patent No.: US 12,643,005 B2
(45) Date of Patent: Jun. 2, 2026

(54) EXERCISE BENCH CAPABLE OF UTILIZING A RESISTANCE DEVICE OF AN EXERCISE APPARATUS

(71) Applicant: Australian Fitness Supplies Pty Ltd., Molendinar (AU)

(72) Inventors: Christopher E. Ward, Molendinar (AU); Laura S. Smith, Molendinar (AU)

(73) Assignee: Australian Fitness Supplies Pty Ltd., Molendinar (AU)

( * ) Notice: Subject to any disclaimer, the term of this patent is extended or adjusted under 35 U.S.C. 154(b) by 0 days.

(21) Appl. No.: 19/235,820

(22) Filed: Jun. 12, 2025

(65) Prior Publication Data

US 2025/0303224 A1 Oct. 2, 2025

Related U.S. Application Data

(63) Continuation of application No. PCT/IB2024/059420, filed on Sep. 26, 2024.

(60) Provisional application No. 63/585,728, filed on Sep. 27, 2023.

(51) Int. Cl.
*A63B 21/00* (2006.01)

(52) U.S. Cl.
CPC ..... *A63B 21/4031* (2015.10); *A63B 21/151* (2013.01)

(58) Field of Classification Search
CPC ... A63B 21/151; A63B 21/154; A63B 21/156; A63B 21/4031; A63B 21/4045
See application file for complete search history.

(56) References Cited

U.S. PATENT DOCUMENTS

| | | | | |
|---|---|---|---|---|
| 4,865,773 | A | 9/1989 | Kim et al. | |
| 7,815,552 | B2 * | 10/2010 | Dibble | A63B 21/154 482/92 |
| 9,724,563 | B2 * | 8/2017 | Schmidt | A63B 71/0622 |
| 11,786,777 | B1 * | 10/2023 | Sleamaker | A63B 21/156 482/110 |
| 2002/0091043 | A1 | 7/2002 | Rexach | |
| 2005/0049121 | A1 | 3/2005 | Dalebout et al. | |
| 2005/0143230 | A1 * | 6/2005 | Dalebout | A63B 23/12 482/121 |
| 2023/0118879 | A1 * | 4/2023 | Yang | A63B 21/0442 482/138 |
| 2025/0049121 | A1 | 2/2025 | Turrini et al. | |

OTHER PUBLICATIONS

International Search Report and Written Opinion for International (PCT) Application No. PCT/IB2024/059420 mailed Jan. 31, 2025.

* cited by examiner

*Primary Examiner* — Zachary T Moore
(74) *Attorney, Agent, or Firm* — Troutman Pepper Locke LLP; Ryan A. Schneider; Dustin B. Weeks

(57) ABSTRACT

This disclosure describes an exercise bench that is positioned near, at, or attached to an exercise apparatus. A cable can be removably coupled between a cable/pulley system of the exercise apparatus and a coupler of the exercise bench. With this example configuration, during an exercise routine, a user of the exercise bench can utilize (i.e., move) a resistance device (e.g., a weight stack) of the exercise apparatus. The exercise bench and exercise apparatus may be implemented in an exercise system.

17 Claims, 11 Drawing Sheets

EXERCISE BENCH CAPABLE OF UTILIZING A RESISTANCE DEVICE OF AN EXERCISE APPARATUS

CROSS-REFERENCE TO RELATED APPLICATION(S)

This application is a continuation of International (PCT) Application No. PCT/IB2024/059420 filed on 26 Sep. 2024, which claims priority to U.S. Provisional Patent Application Ser. No. 63/585,728, filed on Sep. 27, 2023, which is hereby incorporated herein by reference in its entirety.

FIELD OF THE DISCLOSURE

Embodiments of the present disclosure relate generally to exercise systems and, more particularly, to an exercise bench capable of removably securing to an exercise apparatus in order for the bench to utilize a weight stack of the exercise apparatus, and an exercise system that includes the bench and exercise apparatus.

BACKGROUND

An exercise or weight training bench is specialized exercise equipment engineered for use in a wide range of strength training activities. This bench typically comprises a flat, padded surface on which a user can lie, sit, or recline. Frequently, the bench includes adjustable components such as backrests and seat positions to facilitate various exercises and accommodate user preferences. The primary function of a weight training bench is to provide a stable and supportive platform for executing exercises like bench presses, dumbbell presses, and other resistance training routines. Common construction materials for these benches include, for example, durable steel frames and high-density foam padding for enhanced comfort and safety.

Weight training benches are essential fixtures in many areas of strength training. Benches come in various sizes, shapes, and designs, including fixed horizontal, fixed incline and/or decline, and models with one or more adjustable sections. Despite their versatility, current bench designs are limited in the types of exercises, training options, and resistance amounts that can be employed while using these benches, and restricted by their inability to adequately perform effective exercise movements such as for leg presses and squats.

Thus, it is desirable to provide an alternative exercise bench and an exercise system employing the exercise bench that are able to overcome the above disadvantages.

Advantages of the present invention will become more fully apparent from the detailed description of the invention hereinbelow.

SUMMARY

An exemplary embodiment of the present invention provides an exercise bench. The exercise bench can comprise: a movable component configured to move during an exercise routine; and a coupler associated with the movable component. The coupler can be configured to be removably coupled to by a bench connector cable which, in turn, can be configured to be removably coupled to a resistance device cable of an exercise apparatus. The resistance device cable, in turn, can be configured to be coupled to a resistance device of the exercise apparatus. Movement of the movable component during the exercise routine can be configured to cause movement of the bench connector cable, via the coupler, and movement of the resistance device cable, via the bench connector cable, resulting in movement of the resistance device.

Another exemplary embodiment of the present invention provides an exercise system which can comprise an exercise apparatus comprising: a resistance device; and a resistance device cable coupled to the resistance device. The exercise system can also comprise: a bench connector cable comprising a first end and a second end; and an exercise bench. The exercise bench can comprise: a movable component configured to move during an exercise routine; and a coupler associated with the movable component. The first end of the bench connector cable can be configured to be removably coupled to the resistance device cable, and the second end of the bench connector cable can be configured to be removably coupled to the coupler. Movement of the movable component during the exercise routine can be configured to cause movement of the bench connector cable, via the coupler, and movement of the resistance device cable, via the bench connector cable, resulting in movement of the resistance device.

Yet another exemplary embodiment of the present invention provides a method for using an exercise system. The method can comprise providing an exercise apparatus comprising: a resistance device; and a resistance device cable coupled to the resistance device. The method can also comprise moving an exercise bench to a fixed position relative to the exercise apparatus. The exercise bench can comprise: a movable component that moves during an exercise routine; and a coupler associated with the movable component. The method can further comprise: providing a bench connector cable comprising a first end and a second end; removably coupling the first end of the bench connector cable to the resistance device cable; and removably coupling the second end of the bench connector cable to the coupler. The movement of the movable component during the exercise routine can cause movement of the bench connector cable, via the coupler, and movement of the resistance device cable, via the bench connector cable, resulting in movement of the resistance device.

These and other aspects of the present invention are described in the Detailed Description below and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

BRIEF DESCRIPTION OF THE DRAWINGS

The following detailed description of specific embodiments of the disclosure will be better understood when read in conjunction with the appended drawings. For the purpose of illustrating the disclosure, specific embodiments are shown in the drawings. It should be understood, however, that the disclosure is not limited to the precise arrangements and instrumentalities of the embodiments shown in the drawings.

DETAILED DESCRIPTION

Figure 1:
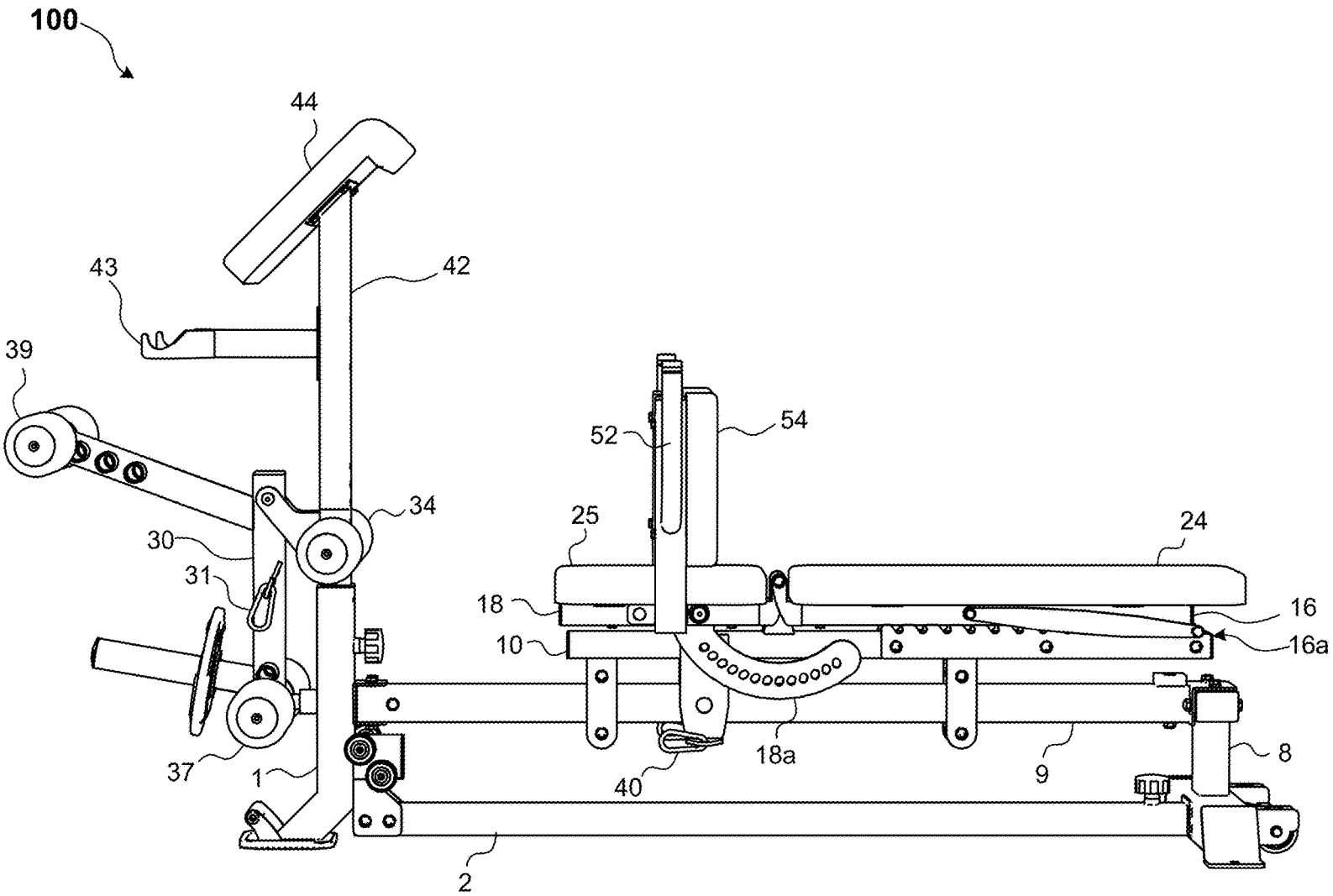
FIG. 1 illustrates a side view of an exercise bench, in accordance with an exemplary embodiment of the present invention.

To facilitate an understanding of the principles and features of the present disclosure, various illustrative embodiments are explained below. The components, steps, and materials described hereinafter as making up various elements of the embodiments disclosed herein are intended to be illustrative and not restrictive. Many suitable components, steps, and materials that would perform the same or similar functions as the components, steps, and materials described herein are intended to be embraced within the scope of the disclosure. Such other components, steps, and materials not described herein can include, but are not limited to, similar components or steps that are developed after development of the embodiments disclosed herein.

It must be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms a, an, and the do not denote a limitation of quantity, but rather denote the presence of at least one of the referenced item.

As used herein, the term "and/or" may mean "and," it may mean "or," it may mean exclusive-or" it may mean "one," it may mean "some, but not all," it may mean "neither," and/or it may mean "both." The term "or" is intended to mean an inclusive "or."

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose. It is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. Further, the term "about" means within an acceptable error range for the particular value as determined by one of ordinary skill in the art, which will depend in part on how the value is measured or determined, i.e., the limitations of the measurement system. For example, "about" can mean within an acceptable standard deviation, per the practice in the art. Alternatively, "about" can mean a range of up to ±20%, preferably up to ±10%, more preferably up to ±5%, and more preferably still up to ±1% of a given value. Alternatively, particularly with respect to biological systems or processes, the term can mean within an order of magnitude, preferably within 2-fold, of a value. Where particular values are described in the application and claims, unless otherwise stated, the term "about" is implicit and in this context means within an acceptable error range for the particular value.

Ranges: throughout this disclosure, various aspects of the disclosure can be presented in a range format. It should be understood that the description in range format is merely for convenience and brevity and should not be construed as an inflexible limitation on the scope of the disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

By "comprising" or "containing" or "including" is meant that at least the named component, element, or method step is present in the system, device, or method, but does not exclude the presence of other elements, components, or method steps, even if the other such compounds, material, particles, method steps have the same function as what is named.

The present invention addresses the limitations mentioned in the Background section above by enabling users to perform a wider range of exercises on the bench itself, eliminating the need for extra equipment. This innovation not only conserves space but also enhances the versatility of the existing design. Key features of this bench, such as the sliding beam running through the center and cable system provide users with a multitude of new training options in a compact and efficient manner.

Embodiments of this disclosure are directed to a versatile exercise bench designed for comprehensive adjustability and integration with a multi-functional exercise apparatus. The bench features a slidable frame with multiple adjustment points, allowing for varied user positions and exercise angles. It may include adjustable back and seat pads, capable of varying degrees of incline, flat and decline ranges, and can support various attachments for exercises such as leg curls, arm curls, and leg presses. The exercise apparatus may incorporate pulley system(s) and weight plate holder(s), providing extensive resistance training options. The bench and apparatus together can form a compact, storable solution exercise system suitable for diverse fitness routines.

Embodiments may comprise a flat incline bench equipped with a sliding mechanism and at least one retractable connector for connecting to the exercise apparatus. The frame of the bench may be constructed from metal or other durable material or compositions, and the seating surfaces are padded and/or cushioned with, for example, high-quality upholstery for comfort. Innovative aspects of the bench include, but are not limited to, the sliding mechanism, the lock-in mechanism similar to a retractable leash or measuring tape, and integration with a resistance device such as a weight stack.

In an embodiment, the bench provide an upright leg press utilizing the sliding bench that is secured at the base of the rack (although it may be secured at other locations) and attaches the cables of the bottom pulley system at the bottom of the machine using the sliding mechanism of the bench to create, for example, a pin loaded upright seated leg press. The footplate near the base of the machine will serve as the leg press plate at an optimal height (which can be adjustable based on the height of the seat of the bench) for leg pressing.

Referring to an example embodiment, FIG. 1 illustrates an exercise bench 100 mounted by two stabilizers, front base frame 1 and rear base frame 8, which allow a slidable frame 10 to secure centrally. The upholstered front pad 25 and rear pad 24 are mounted to front seat frame 18 and rear seat frame 16, respectively. Both couplers 31 and 42 are coupling options. The shoulder pads 54 are mounted on shoulder pad frame 52.

In the example embodiment shown in FIG. 1, the sliding frame 10 is a multi-adjustable sliding frame which allows the user to move freely along the frame between the front base frame 1 and rear base frame 8. Sliding frame 10 also has any number of adjustment points between these two ends which allow the user to lock in using an umbrella pin 10*a* (see FIG. 3).

Both the rear pad 24 and front pad 25 are adjustable with each pad having incline capability to interchange between different movements. This allows the user to be seated in a horizontal plane facing towards the exercise apparatus 101 or away from the exercise apparatus 101.

FIG. 1 displays example attachments on the current invention including, but not limited to, a leg curl/leg extension attachment 30 & arm curl pad 44 and barbell holder 43. Stem 42 supports arm curl pad 44 and barbell holder 43 and may be integral with leg curl/leg extension attachment 30 or it may be removably coupled thereto. Exemplary components also illustrated in FIG. 1 include: leg extension pads 34, 37, leg curl pads 34, 39, front seat frame 18's incline adjustment mechanism 18*a*, and guide rod 9. An incline adjustment mechanism pin 18*b* (shown in FIG. 3) locks the incline adjustment mechanism 18*a* in place.

Figure 2:
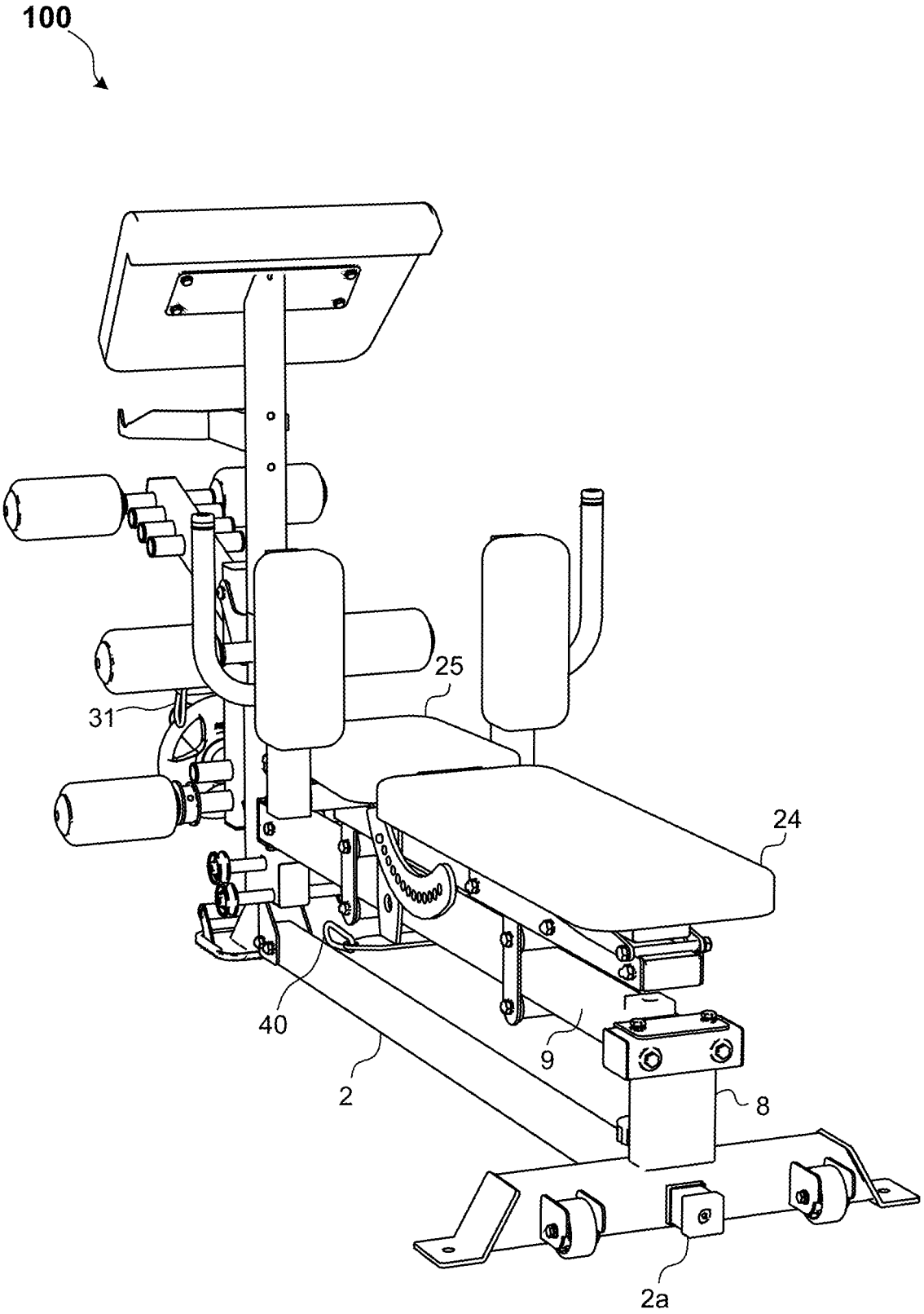
FIG. 2 illustrates a perspective view of the exercise bench shown in FIG. 1.

FIG. 2 illustrates the outer tube 2 (also shown in FIG. 1) having a joining mechanism 2*a* may be an inner support tube which at least partly resides within outer tube 2. Once extended, the joining mechanism 2*a* abuts or connects to a receiver 102 of the exercise apparatus 101 thereby providing stability and strength to the base of the exercise bench 100. The joining mechanism 2*a* may alternatively not be abutted to or connected to the exercise apparatus 101 or its receiver 102. The exercise apparatus 101's receiver 102 may be in proximity to a set of dual low pulleys 183L and 183R. These pulleys of exercise apparatus 101 allow cables 162L and 162R (see FIG. 4) to be movably coupled thereto and serve as part of a resistance device as a connection to various functions of the versatile exercise bench.

Figure 3:
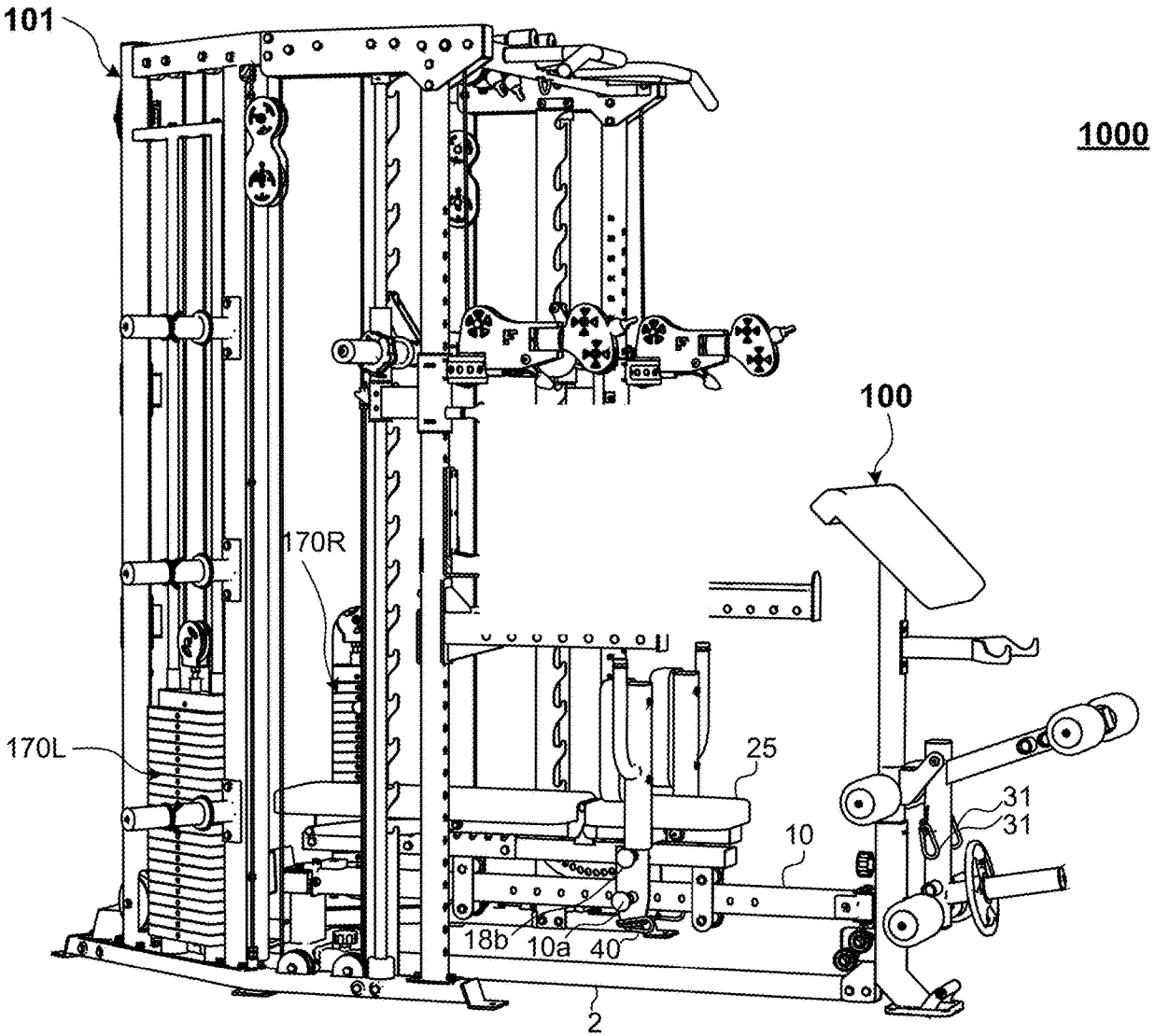
FIG. 3 illustrates a perspective view of an exercise system comprising the exercise bench shown in FIG. 1 and an exercise apparatus, in accordance with an exemplary embodiment of the present invention.

FIG. 3 illustrates a perspective view of an exercise system 1000 comprising the exercise bench 100 shown in FIG. 1 and the exercise apparatus 101.

Figure 4:
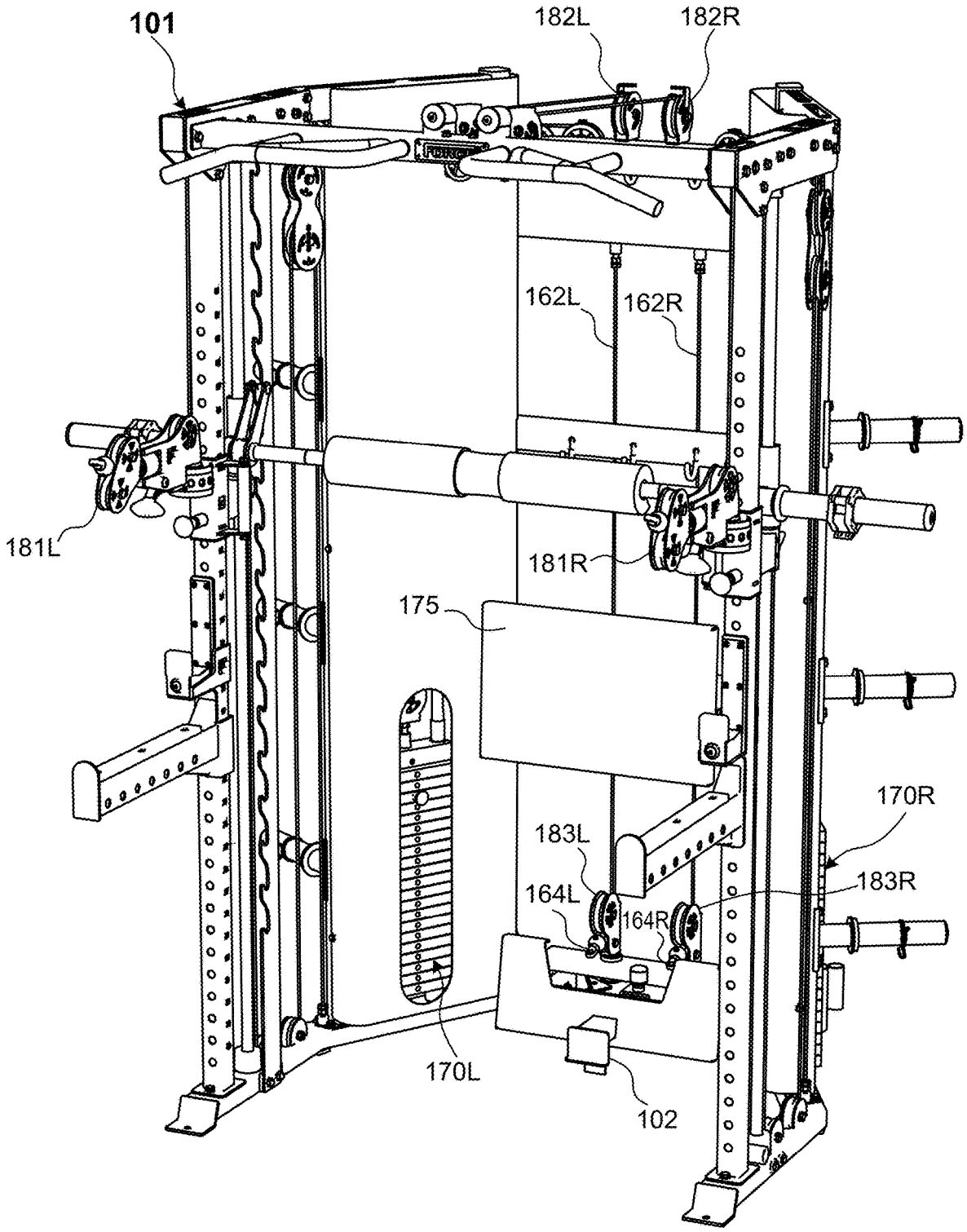
FIG. 4 illustrates the exercise apparatus shown in FIG. 3.

FIG. 4 reveals exercise apparatus 101 and it features three dual pulley systems 181L, 181R, 182L, 182R, 183L, 183R, allowing the user to use pulleys on either side of exercise apparatus 101, at about the middle, top and/or bottom of the apparatus 101, all symmetrically located about a vertical center longitudinal axis of the exercise apparatus 101.

FIG. 4 reveals the location of the weight plate holders on exercise apparatus 101 on either side of the exercise apparatus 101 to hold resistance devices 170L, 170R (e.g., weight stacks).

FIG. 4 details the perspective view of the exercise bench 100 and exercise apparatus 101 which encompasses multiple embodiments related to the adjustable and integrated fitness systems in the present invention. Specifically, the dual pulley systems on either side of the exercise apparatus 101 comprise mid dual pulleys 181L, 181R, top dual pulleys 182L, 182R, and bottom dual pulleys 183L, 183R at the base of the machine. Any one or more of these pulleys may connect to the exercise bench 100 at, for example, either coupler 31 or coupler 40.

FIG. 4 also demonstrates the all-purpose nature of the exercise apparatus 101 with the pulleys 181L and 181R which include on the same framework, the cable system connected to a resistance device, the front upright and smith machine guide rod, offering a complete system.

FIG. 4 also shows the trolleys of the cable pulleys 181L and 181R enabled with 200 degrees of adjustability.

FIG. 4 also detail the components below 183L and 183R on the low row footplate 175 (used for the seated leg press or hack squat) on exercise apparatus 101 where the exercise bench and its joining mechanism 2*a* stabilizes by or within the receiver 102 of exercise apparatus 101.

FIG. 4 reveals an example location and size of the leg press footplate 175 and its overall function and compact nature within the apparatus 101.

Figure 5:
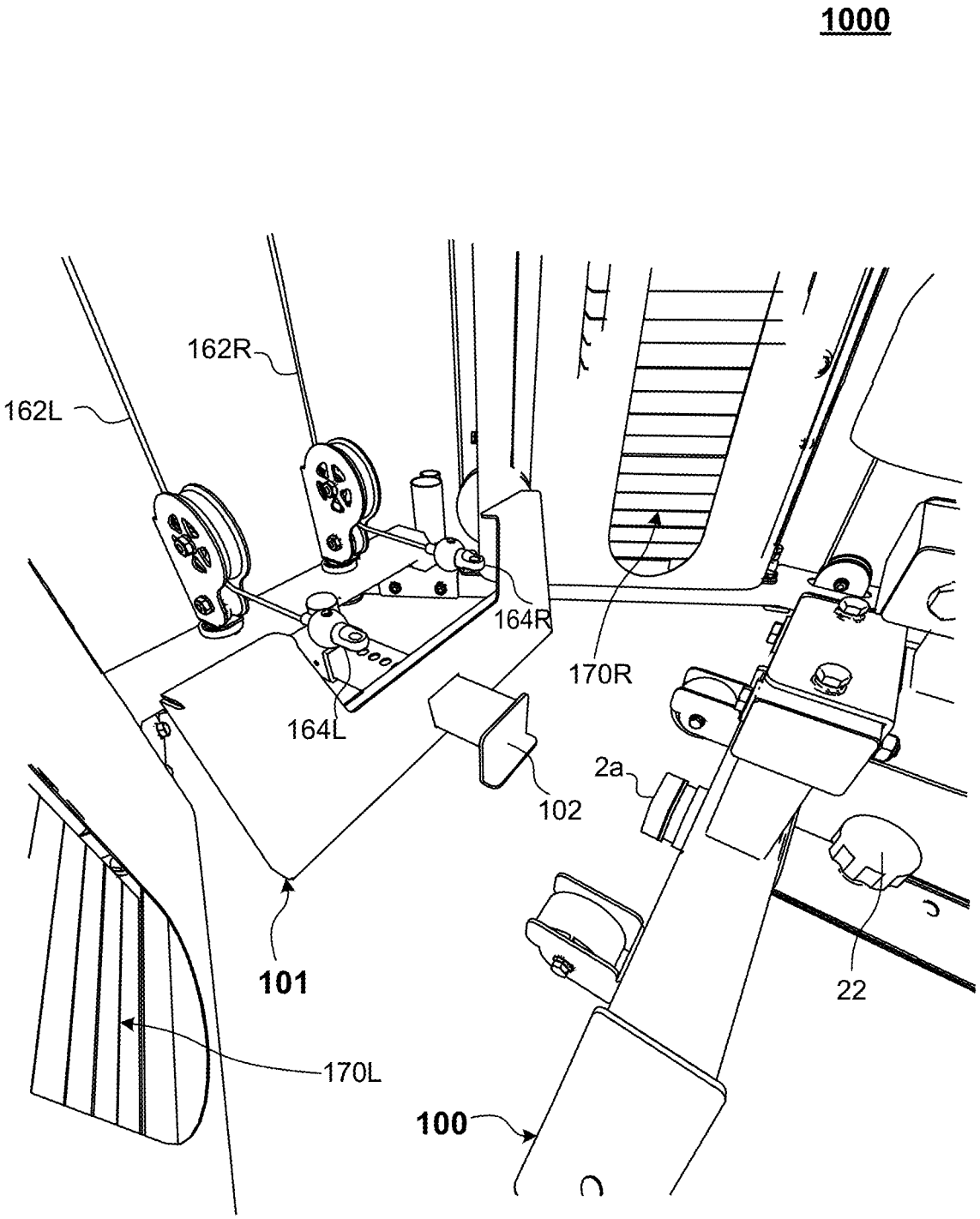
FIG. 5 illustrates a perspective view of the exercise system shown in FIG. 3, with the exercise bench not yet abutted to or attached to the exercise apparatus, in accordance with an exemplary embodiment of the present invention.

FIG. 5 illustrates a perspective view of the exercise system 1000 shown in FIG. 3, with the exercise bench 100 not yet abutted to or attached to the exercise apparatus 101.

Figure 6:
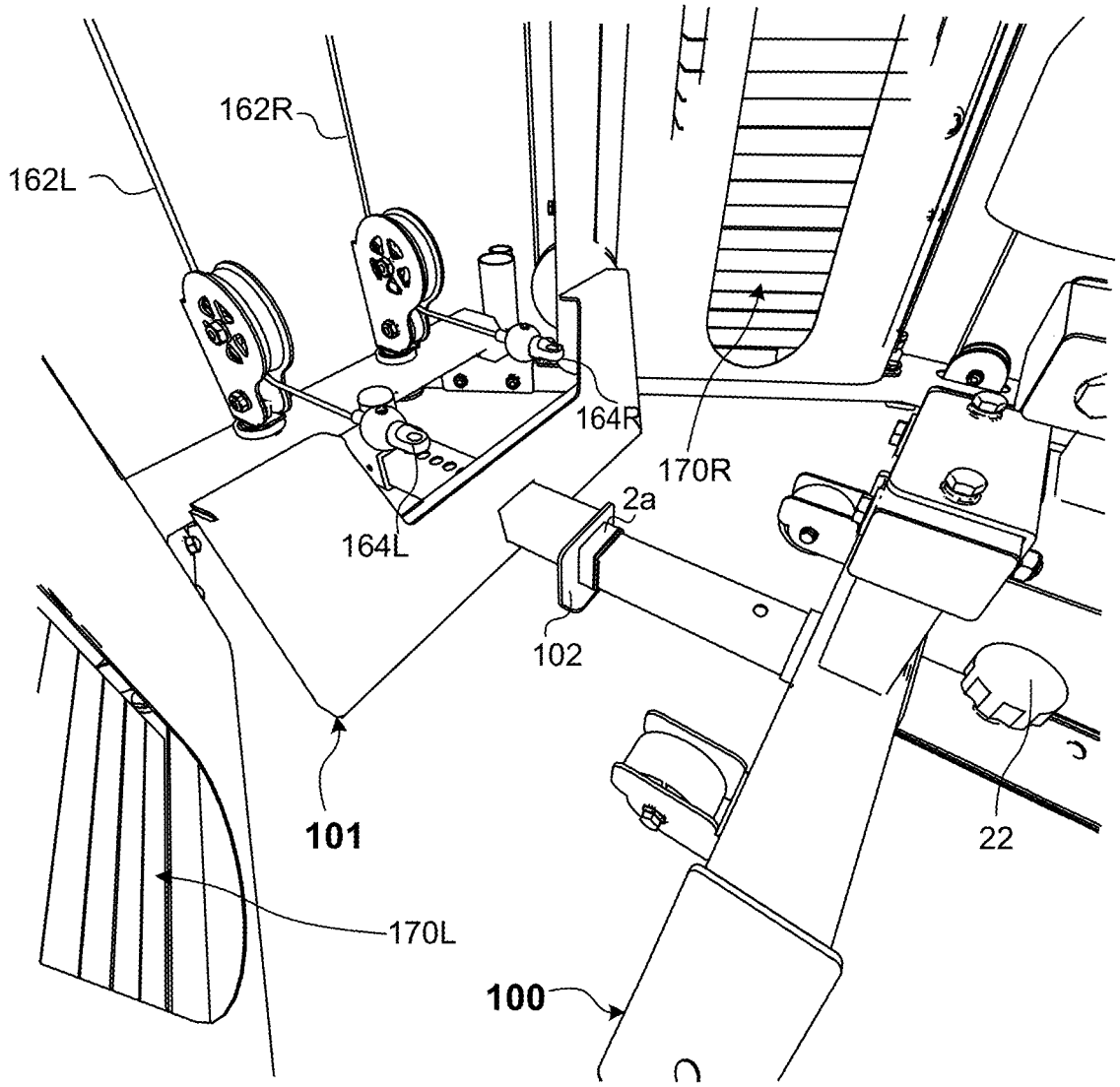
FIG. 6 illustrates a perspective view of the exercise system shown in FIG. 3, with the exercise bench abutted to the exercise apparatus, in accordance with an exemplary embodiment of the present invention.

FIG. 6 illustrates a perspective view of the exercise system 1000 shown in FIG. 3, with the exercise bench 100 abutted to the exercise apparatus 101, via extension of joining mechanism 2*a*. Once the joining mechanism 2*a* is extended in position, it may be locked in place via turning of dial 22 which clamps down on the joining mechanism 2*a* still residing within the hollow shaft of outer tube 2.

Figure 7:
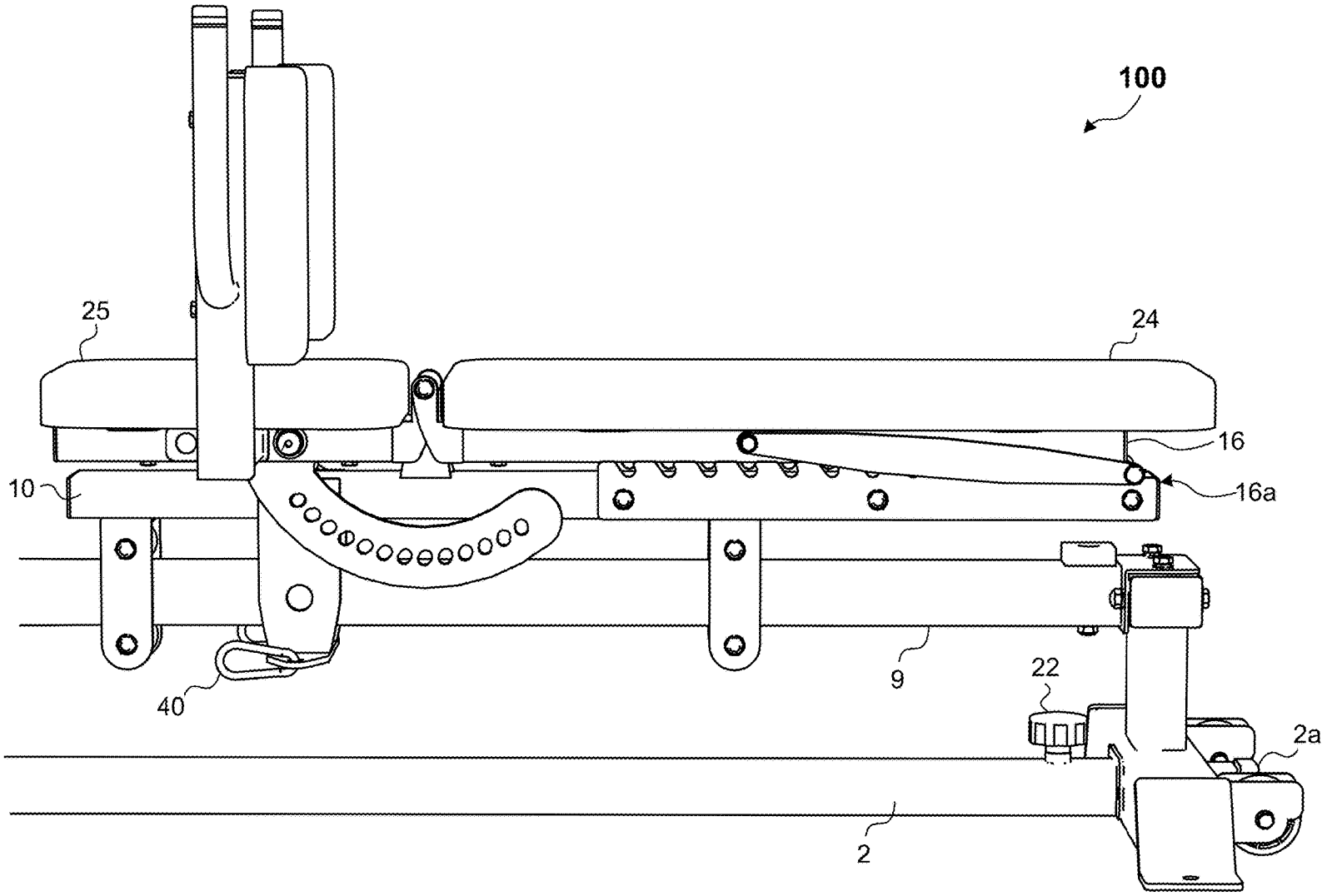
FIG. 7 illustrates an enlarged partial side view of a proximal end of the exercise bench shown in FIG. 1.

FIG. 7 is another view of the example embodiment of FIG. 1 and shows the rear pad adjustment mechanism 16*a* and how the bench secures when employing an incline position along the sliding frame 10.

FIG. 7 also illustrates the multiple points of adjustment on the front seat frame 18 and selection of a different point on that frame results in up to a possible 90-degree angle to use the versatile exercise bench in a horizontal (or less-than horizontal) seated position.

FIG. 7 also shows where the cable could connect to the exercise apparatus 101 from both sides of the bench 100. This cable may extend to the exercise apparatus which connects to the resistance device to perform exercises which include, but are not limited to, horizontal leg press, hack squat, leg curl, leg extension & preacher curl.

Figure 8:
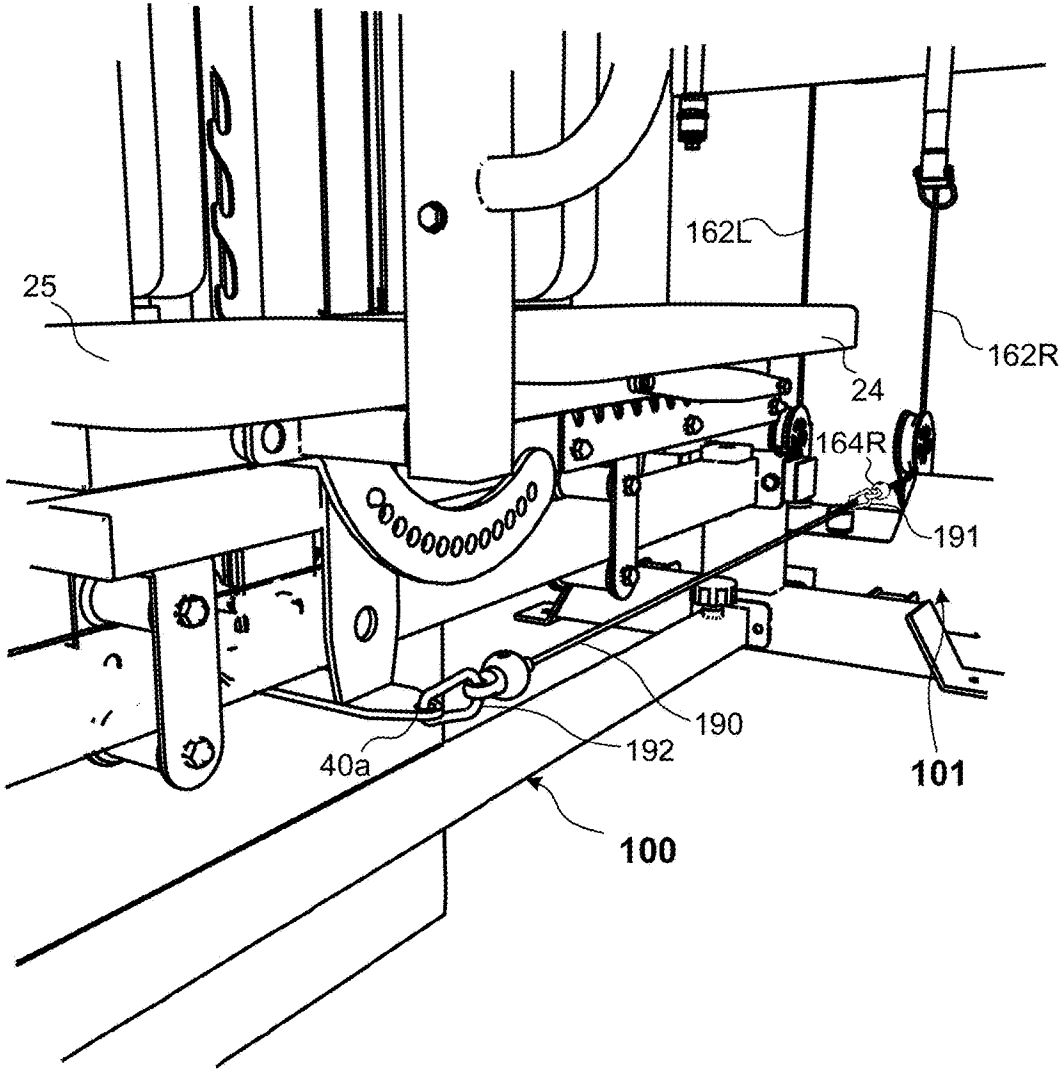
FIG. 8 illustrates a partial perspective view of the proximal end of the exercise bench shown in FIG. 7, along with a bench connector cable removably coupled to a coupler associated with a movable component connected to a padded or cushioned seat, in accordance with an exemplary embodiment of the present invention.

FIG. 8 illustrates a partial perspective view of the proximal end of the exercise bench 100 shown in FIG. 7, along with a bench connector cable 190 removably coupled to a coupler 40*a* (e.g., hole, slot, or hook), via a carabiner 192, associated with a movable component connected to a padded or cushioned seat. The bench connector cable 190 is also removably coupled to either of the coupler ends 164L, 164R of cables 162L, 162R via, for example, a coupler such as a carabiner 191.

Figure 9:
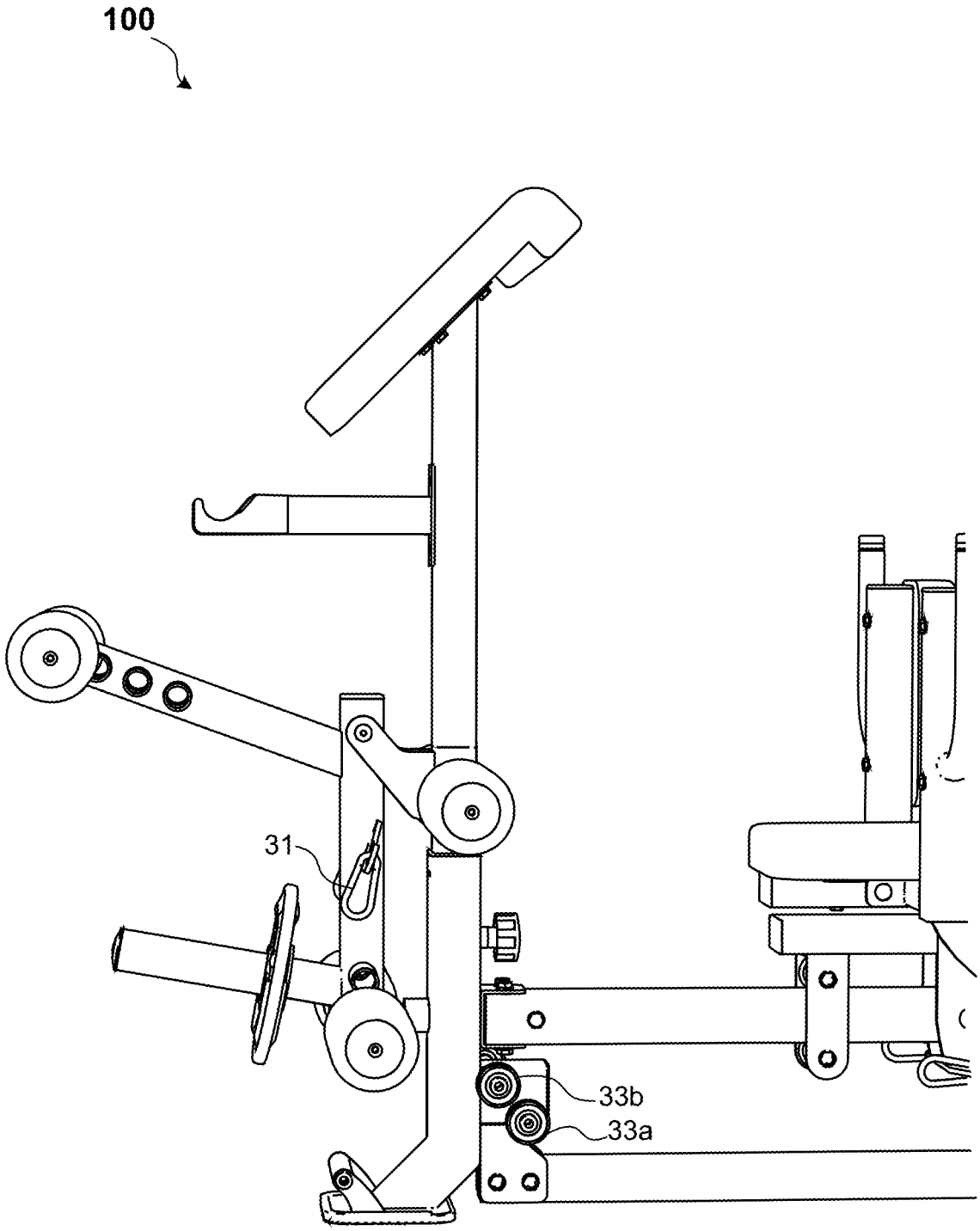
FIG. 9 illustrates an enlarged partial side view of a distal end of the exercise bench shown in FIG. 1.

FIG. 9 illustrates the distal end of the exercise bench 100 to the exercise apparatus 101 with the leg attachment and arm curl attachment. Also illustrated are pulleys 33*a*, 33*b* used for a cable such as cable 162R (FIG. 10) or cable 190 (FIG. 8) extending to the exercise apparatus 101.

Figure 10:
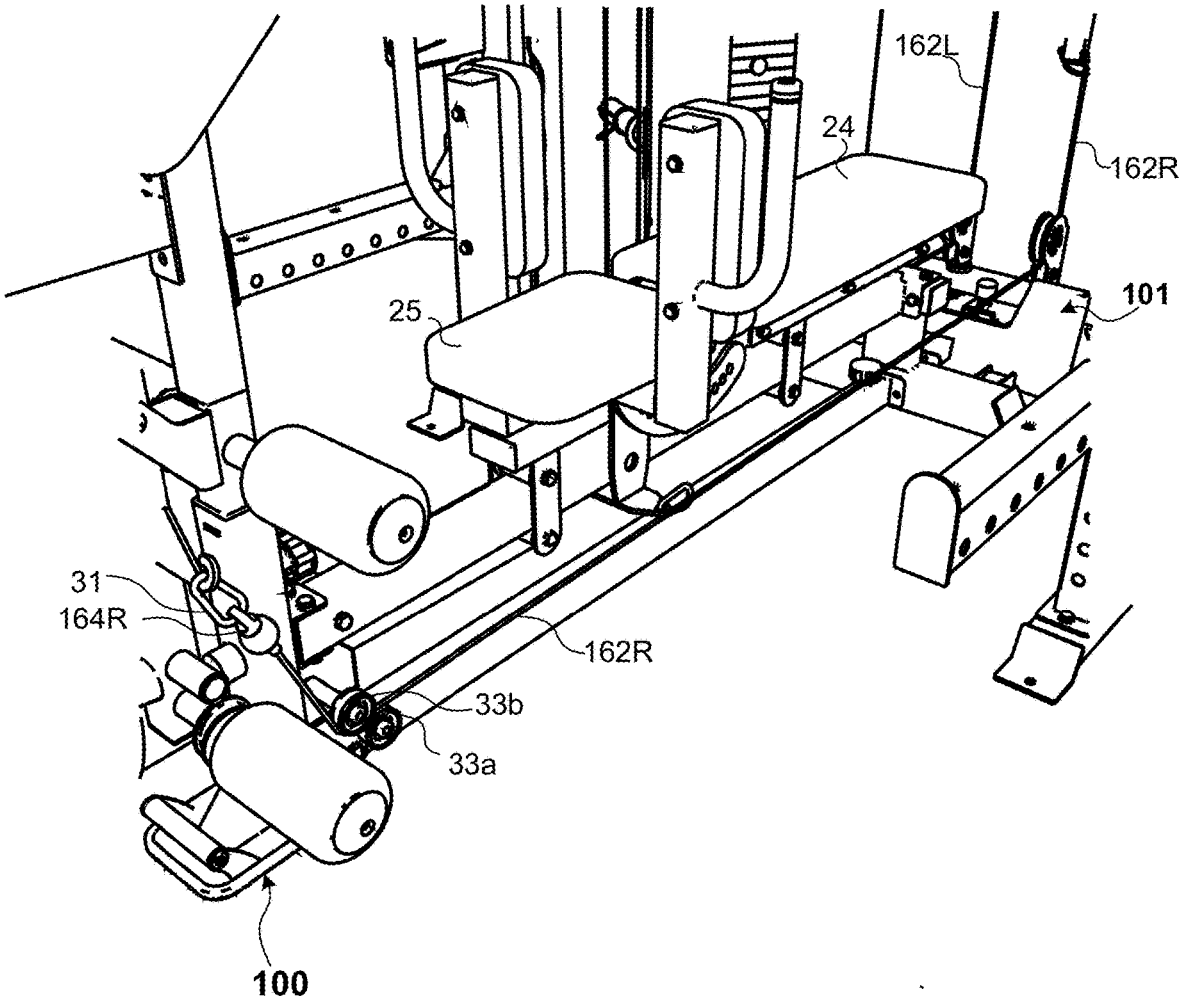
FIG. 10 illustrates a partial perspective view of the distal end of the exercise bench shown in FIG. 9, along with a bench connector cable (from the exercise apparatus) removably coupled to a coupler associated with a movable component connected to a leg pad or leg cushion, in accordance with an exemplary embodiment of the present invention.

FIG. 10 illustrates a partial perspective view of the distal end of the exercise bench 100 shown in FIG. 9, along with a bench connector cable (i.e., cable 162R from the exercise apparatus 101) removably coupled to a coupler 31 (i.e., shown in the form of either or both of a hook and/or carabiner) associated with a movable component connected to a leg pad or leg cushion.

In an alternative embodiment, a retractable cable system (not shown) could fit on the exercise bench. The retractable cable, similar to those found in retractable leashes or measuring tapes, may be attached to the underside on the sliding frame 10, front seat frame 18 or rear seat frame 16. This cable may connect to one or more of the cables 162L, 162R, enabling smooth resistance during exercises. The retractable cable can be locked into place to secure the desired length and tension and can be varied for each movement and height of users. Integrated handles and an easy locking system will make this machine a great user experience. An alternate design for the retractable connector (or any cable that attaches to exercise apparatus 101 for that matter) may be located, for example, on any point along the sliding frame 10.

An exemplary embodiment of the present invention provides an exercise bench 100. The exercise bench 100 can comprise: a movable component (e.g., slidable frame 10) configured to move during an exercise routine; and a coupler (e.g. 31, 40, 40*a*) associated with the movable component. The coupler can be configured to be removably coupled to by a bench connector cable (e.g., cable 190) which, in turn, can be configured to be removably coupled to a resistance device cable (e.g., cables 162L, 162R) of an exercise apparatus. The resistance device cable, in turn, can be configured to be coupled to a resistance device (e.g., resistance devices 170L, 170R) of the exercise apparatus 101. Movement of the movable component during the exercise routine can be configured to cause movement of the bench connector cable, via the coupler, and movement of the resistance device cable, via the bench connector cable, resulting in movement of the resistance device.

Another exemplary embodiment of the present invention provides an exercise system which can comprise an exercise apparatus comprising: a resistance device; and a resistance device cable coupled to the resistance device. The exercise system can also comprise: a bench connector cable comprising a first end and a second end; and an exercise bench. The exercise bench can comprise: a movable component configured to move during an exercise routine; and a coupler associated with the movable component. The first end of the bench connector cable can be configured to be removably coupled to the resistance device cable, and the second end of the bench connector cable can be configured to be removably coupled to the coupler. Movement of the movable component during the exercise routine can be configured to cause movement of the bench connector cable, via the coupler, and movement of the resistance device cable, via the bench connector cable, resulting in movement of the resistance device.

In any of the embodiments described herein, the exercise bench further comprises a joining mechanism 2*a* configured to be abutted to or removably connected to the exercise apparatus during the exercise routine. Joining mechanism can alternatively be any type of fastener.

In any of the embodiments described herein, the coupler is integral with the movable component and comprises a hole, slot, or hook, or the coupler comprises a carabiner or other fastener capable of being removably secured to the movable component.

In any of the embodiments described herein, the resistance device comprises a device selected from the group consisting of a weight stack, an exercise band, a plate-loaded weight, and a combination thereof.

In any of the embodiments described herein, the movable component is connected to a padded or cushioned seat, and wherein the padded or cushioned seat is configured to move along with the movable component during the exercise routine. The exercise routine may be a seated leg press or hack squat.

In any of the embodiments described herein, the movable component is connected to a leg pad or leg cushion, and wherein the leg pad or leg cushion is configured to move along with the movable component during the exercise routine. The exercise routine may be a seated leg extension or leg curl.

In any of the embodiments described herein, the movable component comprises a preacher curl bar which can be placed on barbell holder 43. The exercise routine may be a preacher curl.

Figure 11:
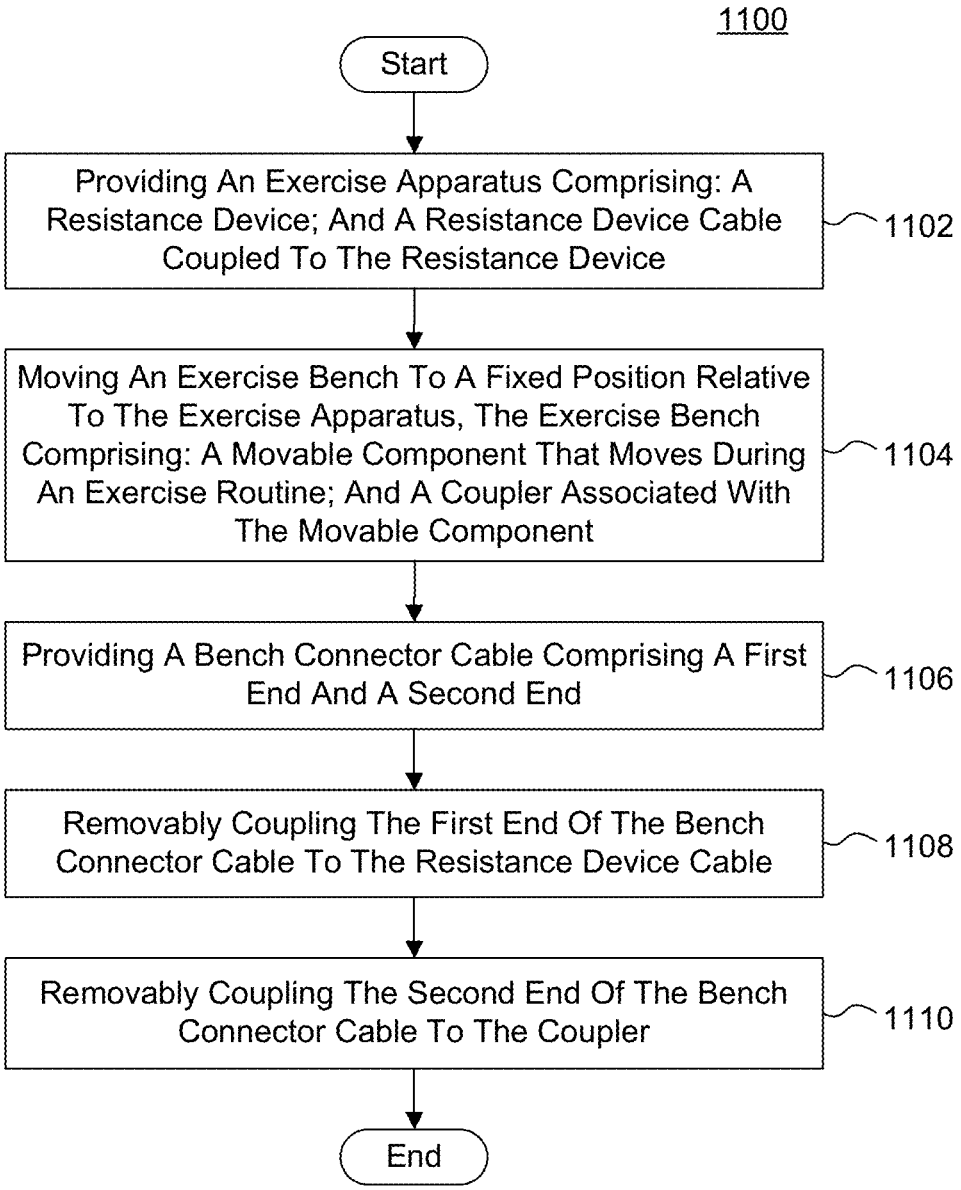
FIG. 11 is a flowchart of a method for using an exercise system, in accordance with an exemplary embodiment of the present invention.

With reference to FIG. 11, yet another exemplary embodiment of the present invention provides a method 1100 for using an exercise system. The method 1100 can comprise providing an exercise apparatus comprising: a resistance device; and a resistance device cable coupled to the resistance device (block 1102). The method can also comprise moving an exercise bench to a fixed position relative to the exercise apparatus, with the exercise bench comprising: a movable component that moves during an exercise routine; and a coupler associated with the movable component (block 1104). The method can further comprise: providing a bench connector cable comprising a first end and a second end (block 1106); removably coupling the first end of the bench connector cable to the resistance device cable (block

1108); and removably coupling the second end of the bench connector cable to the coupler (block 1110). The movement of the movable component during the exercise routine can cause movement of the bench connector cable, via the coupler, and movement of the resistance device cable, via the bench connector cable, resulting in movement of the resistance device.

The cable (e.g., 190, or 162L, 162R associated with pulleys 183L, 183R, or even any other cable associated with any of the other pulleys 181L, 181R, 182L, 182R) that attaches to the bench 100 described in any of the above embodiments may alternatively be housed within component(s) of the bench such as inside guide rod 9 (i.e., if hollow) or on either or both sides of the bench 100. Any cable(s) may be provided on either side or both sides of the bench, along with their corresponding coupler such as carabiner 40.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. An exercise bench comprising:

a movable component configured to move during an exercise routine; and a coupler associated with the movable component, wherein the coupler is configured to be removably coupled to one or more cables, the one or more cables being configured to operatively connect the movable component to a resistance device of an exercise apparatus;

wherein movement of the movable component during the exercise routine is configured to cause movement of the one or more cables, via the coupler, resulting in movement of the resistance device; and wherein the exercise bench is removably coupled to the exercise apparatus via rotation of a dial.

2. The exercise bench of claim 1, wherein the exercise bench further comprises a joining mechanism configured to be abutted to or removably connected to the exercise apparatus during the exercise routine.

3. The exercise bench of claim 1, wherein the coupler is integral with the movable component and comprises a hole, slot, or hook, or the coupler comprises a carabiner or other fastener capable of being removably secured to the movable component.

4. The exercise bench of claim 1, wherein the resistance device comprises a device selected from the group consisting of a weight stack, an exercise band, a plate-loaded weight, and a combination thereof.

5. The exercise bench of claim 1, wherein the movable component is connected to a padded or cushioned seat, and wherein the padded or cushioned seat is configured to move along with the movable component during the exercise routine.

6. The exercise bench of claim 5, wherein the exercise routine is a seated leg press or hack squat.

7. An exercise system comprising:

an exercise apparatus comprising:

a resistance device; and one or more cables coupled to the resistance device; and an exercise bench comprising:

a movable component configured to move during an exercise routine; and a coupler associated with the movable component, wherein the one or more cables is further configured to be removably coupled to the coupler;

wherein movement of the movable component during the exercise routine is configured to cause movement of the resistance device, via the coupler and one or more cables; and wherein the exercise bench is removably coupled to the exercise apparatus via rotation of a dial.

8. The exercise system of claim 7, wherein the exercise bench further comprises a joining mechanism configured to be abutted to or removably connected to the exercise apparatus during the exercise routine.

9. The exercise system of claim 7, wherein the coupler is integral with the movable component and comprises a hole, slot, or hook, or the coupler comprises a carabiner or other fastener capable of being removably secured to the movable component.

10. The exercise system of claim 7, wherein the resistance device comprises a device selected from the group consisting of a weight stack, an exercise band, a plate-loaded weight, and a combination thereof.

11. The exercise system of claim 7, wherein the movable component is connected to a padded or cushioned seat, and wherein the padded or cushioned seat is configured to move along with the movable component during the exercise routine.

12. A method for using an exercise system, the method comprising:

providing an exercise apparatus comprising:

a resistance device; and one or more cables coupled to the resistance device;

providing an exercise bench to a fixed position relative to the exercise apparatus, the exercise bench comprising:

a movable component configured to move during an exercise routine; and a coupler associated with the movable component;

removably coupling the exercise bench to the exercise apparatus;

removably coupling the one or more cables to the coupler; and decoupling the exercise bench from the exercise apparatus, wherein the exercise bench remains an intact functioning exercise bench after decoupling;

wherein the movement of the movable component during the exercise routine causes movement of the resistance device, via the coupler and one or more cables.

13. The method of claim 12, wherein the exercise bench further comprises a joining mechanism, and wherein the providing the exercise bench comprises abutting or removably connecting the joining mechanism to the exercise apparatus prior to the exercise routine.

14. The method of claim 12, wherein the coupler is integral with the movable component and comprises a hole, slot, or hook, or the coupler comprises a carabiner or other fastener that is removably secured to the movable component.

15. The method of claim 12, wherein the resistance device comprises a device selected from the group consisting of a weight stack, an exercise band, a plate-loaded weight, and a combination thereof.

16. The method of claim 12, wherein the movable component is connected to a padded or cushioned seat, and wherein the padded or cushioned seat moves along with the movable component during the exercise routine.

17. The method of claim 16, wherein the exercise routine is a seated leg press or hack squat.

* * * * *